US007699305B2

(12) United States Patent
Totsuka et al.

(10) Patent No.: US 7,699,305 B2
(45) Date of Patent: Apr. 20, 2010

(54) SMART PICK CONTROL ALGORITHM FOR AN IMAGE FORMING DEVICE

(75) Inventors: Kenji Totsuka, Lexington, KY (US); John Spicer, Lexington, KY (US); Delbert Lester Elliott, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/693,103

(22) Filed: Mar. 29, 2007

(65) Prior Publication Data

US 2008/0237969 A1 Oct. 2, 2008

(51) Int. Cl.
*B65H 7/08* (2006.01)

(52) U.S. Cl. ..... 271/111; 271/110

(58) Field of Classification Search ..... 271/110, 271/111; 399/388, 389, 394, 396
See application file for complete search history.

(56) References Cited

U.S. PATENT DOCUMENTS

| | | | |
|---|---|---|---|
| 90,992 | A | 6/1869 | Cardot |
| 109,299 | A | 11/1870 | Goldwell |
| 116,413 | A | 6/1871 | Close |
| 360,393 | A | 3/1887 | Rogers |
| 1,362,011 | A | 12/1920 | Kirby |
| 1,719,881 | A | 7/1929 | Farmer |
| 2,232,090 | A | 2/1941 | Anderson |
| 3,040,853 | A | 6/1962 | Svendsen |
| 3,503,490 | A | 3/1970 | Heyne |
| 3,606,938 | A | 9/1971 | Heyne |
| 3,902,713 | A | 9/1975 | Von Luhmann et al. |
| 3,968,364 | A | 7/1976 | Miller |
| 4,320,953 | A | 3/1982 | Schultes et al. |
| 4,411,511 | A | 10/1983 | Ariyama et al. |
| 4,456,235 | A | 6/1984 | Colglazier et al. |
| 4,544,294 | A | 10/1985 | Runzi |
| 4,548,316 | A | 10/1985 | Maurer |
| 4,566,547 | A | 1/1986 | Furukawa |
| 4,566,684 | A | 1/1986 | Gysling |
| 4,577,849 | A | 3/1986 | Watanabe |
| 4,580,890 | A | 4/1986 | Sugizaki et al. |
| 4,589,765 | A | 5/1986 | Perun et al. |
| 4,660,821 | A | 4/1987 | Boser et al. |
| 4,682,769 | A | 7/1987 | Murakami et al. |
| 4,730,932 | A | 3/1988 | Iga et al. |
| 4,744,687 | A | 5/1988 | Nukaya et al. |
| 4,766,463 | A | 8/1988 | Watanuki et al. |
| 4,790,524 | A | 12/1988 | Murakami et al. |
| 4,793,606 | A | 12/1988 | Yasuoka et al. |
| 4,809,969 | A | 3/1989 | Bastow et al. |
| 4,864,124 | A | 9/1989 | Mirabella, Jr. et al. |
| 4,865,305 | A | 9/1989 | Momiyama et al. |
| 4,868,609 | A | 9/1989 | Nagata et al. |
| 4,872,659 | A | 10/1989 | Kato et al. |
| 4,884,796 | A | 12/1989 | Daboub |

(Continued)

*Primary Examiner*—Patrick H Mackey
*Assistant Examiner*—Ernesto Suarez

(57) ABSTRACT

A method and device disclosed herein controls the movement of media sheets within an image forming device using a pick mechanism that contacts and moves a media sheet from an input area into a media path. One embodiment controls the rotational speed of the pick mechanism based on a filtered combination of a pick mechanism signal and an encoder signal. An encoder roller positioned to contact the media sheets in the input area senses the movement of the media sheet to generate the encoder signal.

8 Claims, 11 Drawing Sheets

U.S. PATENT DOCUMENTS 4,900,003 A 2/1990 Hasimoto
4,951,090 A 8/1990 Matsumoto et al.
4,990,011 A 2/1991 Underwood et al.
5,005,820 A 4/1991 Leemhuis
5,008,715 A 4/1991 Imaizumi et al.
5,056,771 A 10/1991 Beck et al.
5,078,379 A 1/1992 Leisner
5,081,595 A 1/1992 Moreno et al.
5,093,690 A 3/1992 Ohno et al.
5,098,080 A 3/1992 Arnone et al.
5,116,034 A 5/1992 Trask et al.
5,121,914 A 6/1992 Hargreaves
5,121,915 A 6/1992 Duncan et al.
5,125,641 A 6/1992 Kruger
5,139,339 A 8/1992 Courtney et al.
5,141,217 A 8/1992 Lim et al.
5,147,020 A 9/1992 Scherman et al.
5,169,136 A 12/1992 Yamagata et al.
5,177,544 A 1/1993 Kimura et al.
5,195,737 A 3/1993 Ifkovits, Jr. et al.
5,197,726 A 3/1993 Nogami
5,200,608 A 4/1993 Kitajima
5,207,416 A 5/1993 Soler
5,216,472 A 6/1993 Muto et al.
5,253,856 A 10/1993 Fuchi et al.
5,277,415 A 1/1994 Kinoshita et al.
5,297,376 A 3/1994 Taguchi et al.
5,390,773 A 2/1995 Proia
5,393,044 A 2/1995 Hagihara et al.
5,423,527 A 6/1995 Tranquilla
5,424,821 A 6/1995 Sampath
5,428,431 A 6/1995 Abe et al.
5,463,217 A 10/1995 Sobol et al.
5,465,995 A 11/1995 Sedlmair
5,495,326 A 2/1996 Mikida
5,501,444 A 3/1996 Yikimachi et al.
5,507,478 A 4/1996 Nottingham et al.
5,518,230 A 5/1996 Scarlata et al.
5,526,104 A 6/1996 Kawano
5,547,181 A 8/1996 Underwood
5,551,686 A 9/1996 Sanchez et al.
5,558,193 A 9/1996 Jenkins et al.
RE35,341 E 10/1996 Kikuchi et al.
5,573,234 A 11/1996 Petocchi
5,574,527 A 11/1996 Folkins
5,580,046 A 12/1996 Beaufort et al.
5,651,538 A 7/1997 Chung et al.
5,662,321 A * 9/1997 Borostyan et al. ..... 271/10.03
5,662,364 A 9/1997 Reeb et al.
5,667,215 A 9/1997 Yoshino
5,692,741 A 12/1997 Nakamura et al.
5,790,933 A 8/1998 Williams
5,823,529 A 10/1998 Mandel et al.
5,826,135 A 10/1998 Lee
5,839,015 A 11/1998 Faguy et al.
5,842,694 A 12/1998 Brooks et al.
5,878,321 A 3/1999 Miyazaki et al.
5,884,135 A 3/1999 Moore
5,897,112 A 4/1999 Kwag
5,915,690 A 6/1999 Surya
5,934,140 A * 8/1999 Jackson et al. ..... 73/159
5,961,115 A 10/1999 Blanck et al.
5,996,995 A 12/1999 Kim et al.
6,018,164 A 1/2000 Mullens
6,022,013 A 2/2000 Foglino et al.
6,076,821 A 6/2000 Embry et al.
6,100,993 A 8/2000 Eom
6,148,172 A 11/2000 Kanda et al.
6,168,333 B1 * 1/2001 Merz et al. ..... 400/634
6,170,816 B1 1/2001 Gillmann et al.
6,252,654 B1 6/2001 Kaya
6,291,829 B1 9/2001 Allen et al.
6,293,537 B1 9/2001 Park
6,330,424 B1 12/2001 Chapman et al.
6,360,064 B1 3/2002 Regelsberger et al.
6,371,476 B2 4/2002 Isogai et al.
6,382,618 B1 5/2002 Takada
6,386,669 B1 5/2002 Scofield et al.
6,390,467 B1 5/2002 Fukube
6,438,351 B2 8/2002 Kawachi et al.
6,446,954 B1 9/2002 Lim et al.
6,454,069 B2 9/2002 Oh
6,462,822 B1 10/2002 Haines et al.
6,470,164 B1 10/2002 Fukuyama
6,519,443 B1 * 2/2003 Coriale et al. ..... 399/388
6,527,097 B2 3/2003 Dreyer
6,572,096 B1 * 6/2003 Johnson et al. ..... 271/25
6,585,344 B2 7/2003 Kolodziej
6,590,223 B1 7/2003 Chelvayohan
6,592,119 B2 7/2003 Goldbeck et al.
6,599,041 B1 7/2003 Ahne et al.
6,600,167 B2 7/2003 Sano
6,639,238 B2 10/2003 Kuo et al.
6,644,452 B2 11/2003 Lew et al.
6,679,490 B2 1/2004 Pioquinto et al.
6,724,506 B1 4/2004 Wang
6,729,613 B2 * 5/2004 Marra et al. ..... 271/10.02
6,736,389 B2 5/2004 Kosmoski
6,794,668 B2 9/2004 Barnes
6,794,669 B2 9/2004 Chelvayohan et al.
6,926,272 B2 8/2005 Carter et al.
6,955,252 B2 10/2005 Allport
7,039,349 B2 5/2006 Sohmiya et al.
2001/0052666 A1 12/2001 Kuwata et al.
2003/0085513 A1 * 5/2003 Takahara et al. ..... 271/270
2004/0156666 A1 8/2004 Ouchi et al.
2004/0217541 A1 11/2004 Horio
2005/0092572 A1 5/2005 Kuo
2006/0187289 A1 8/2006 Nakashima
2006/0188305 A1 8/2006 Murrell et al.
2006/0192832 A1 8/2006 Nakashima

* cited by examiner

SMART PICK CONTROL ALGORITHM FOR AN IMAGE FORMING DEVICE

BACKGROUND

The present application is directed to devices for moving media sheets within an image forming device and, more specifically, to devices for staging and moving the media sheets to prevent print defects.

An image forming device, such as a color laser printer, facsimile machine, copier, all-in-one device, etc, transfers toner from a photoconductive member to a media sheet. The device may include a double transfer system with the toner initially transferred from a photoconductive member to an intermediate member at a first transfer location, and then from the intermediate member to the media sheet at a second transfer location. The device may also include a direct transfer system with the toner directly transferred from the photoconductive member to a media sheet. In both cases, a media sheet is moved along a media path to intercept and receive the toner image.

The media sheet should be accurately moved along the media path to receive the toner image. If the media sheet arrives before the toner image, the toner image may be transferred to the media sheet at a position that is too low or partially off the bottom of the sheet. Conversely, if the media sheet arrives after the toner image, the toner image may be transferred at a position that is too high or partially off the top of the sheet.

The media path may be configured to increase and decrease the speed of the media sheet and thus affect the timing of the media sheet. However, the amount of correction may be limited and large corrections may not be possible. Inherent with this concept is that a shorter media path offers less opportunity for correction. Many image forming devices include short media paths in an effort to reduce the overall size of the device.

SUMMARY

The present application is directed to methods and devices for controlling the movement of media sheets within an image forming device using a pick mechanism that contacts and moves a media sheet from an input area into a media path. One embodiment comprises a control method for controlling the rotational speed of the pick mechanism based on one or more sensor signals. An encoder roller positioned to contact the media sheets in the input area senses the movement of the media sheet to generate a first sensor signal. A pick mechanism having a motor that drives a pick member positioned to contact the media sheets generates a second sensor signal. In one embodiment, the movement of the media sheet is controlled by controlling the motor of the pick mechanism based on a filtered combination of the first and second sensor signals. In one embodiment, the pick member rotates at a first speed during movement of the media sheet a first distance, and rotates at a second speed during movement of the media sheet a second distance.

DETAILED DESCRIPTION

The present application is directed to methods and devices for controlling the movement of media sheets within an image forming device using a pick mechanism that contacts and moves a media sheet from an input area info a media path. One embodiment comprises a control method for controlling the rotational speed of the pick mechanism based on one or more sensor signals. An encoder roller positioned to contact the media sheets in the input area senses the movement of the media sheet to generate at least one of the sensor signals.

Figure 1:
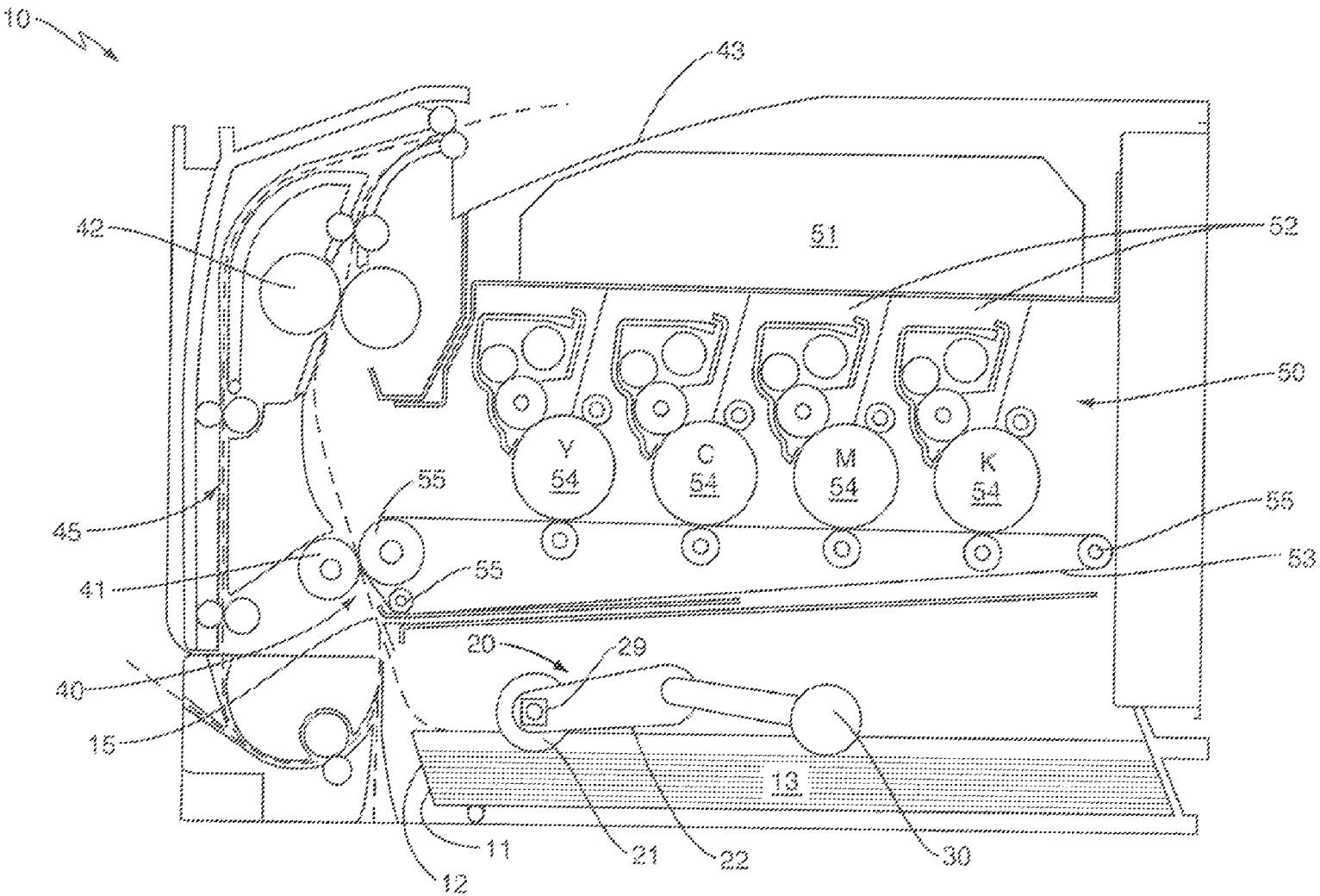
FIG. 1 shows a schematic view of an image forming device according to one embodiment.

FIG. 1 illustrates one embodiment of an image forming device 10. The device 10 includes an input tray 11 with a ramp 12 and being sized to contain a stack of media sheets 13. A pick mechanism 20 is positioned at the input tray 11 for moving a top-most sheet from the stack 13 along the ramp 12 and into a media path 15. Pick mechanism 20 includes an arm 22 and a roller 21. Arm 22 is pivotally mounted to maintain the roller 21 in contact with the top-most sheet of the stack 13. Pick mechanism 20 may include a clutch 29 that affects the movement of the roller 21. In one specific embodiment, clutch 29 is a ball clutch as disclosed in U.S. patent application Ser. No. 10/436,406 entitled "Pick Mechanism and Algorithm for an Image Forming Apparatus" filed on May 12, 2003, and herein incorporated by reference. A smart pick encoder 30 is positioned at the input tray 11 to track the movement of the media sheet as will be explained in detail below. The media sheets move from the input tray 11 along the media path 15 to a second transfer area 40 where they receive a toner image from an image formation area 50. In one embodiment, the pick mechanism 20 is a mechanism as described in U.S. patent application Ser. No. 11/406,610 entitled "Devices for Moving a Media Sheet Within an Image Forming Apparatus" and U.S. patent application Ser. No. 11/406,579 entitled "Methods for Moving a Media Sheet Within an Image Forming Device," both of which were filed on 19 Apr. 2006 and are herein incorporated by reference.

The image formation area 50 includes a laser printhead 51, one or more image forming units 52, and a transfer member 53. Laser printhead 51 includes a laser that discharges a surface of photoconductive members 54 within each of the image forming units 52. Toner from a toner reservoir is attracted to the surface area affected by the laser printhead 51. In one embodiment, the toner reservoirs (not illustrated) are independent of the image forming units 52 and may be removed and replaced from the device 10 as necessary. In another embodiment, the toner reservoirs are integral with the image forming units 52. In one embodiment, the device 10 is a mono printer comprising a single image forming unit 52 for forming toner images in a single color. In another embodiment, the device 10 includes four separate image forming units 52, each being substantially the same except for the color of the toner. In one embodiment, the device 10 includes image forming units 52 each containing one of black, magenta, cyan, and yellow toner, as shown in FIG. 1.

The transfer member 53 extends continuously around a series of rollers 55. Transfer member 53 receives the toner images from each of the photoconductive members 54 and moves the images to the second transfer area 40 where the toner images are transferred to the media sheet. In one embodiment, the toner images from each of the photoconductive members 54 are placed onto the member 53 in an overlapping arrangement. In one embodiment, a multi-color toner image is formed during a single pass of the transfer member 53. By way of example as viewed in FIG. 1, the yellow toner is placed first on the transfer member 53, followed by cyan, magenta, and black.

The second transfer area 40 includes a nip formed by a second transfer roller 41 and one of the rollers 55. A media sheet is moved along the media path 15 through the nip to receive the toner images from the transfer member 53. The media sheet with the toner images next moves through a fuser 42 to adhere the toner images to the media sheet. The media sheet is then either discharged into an output tray 43 or moved into a duplex path 45 for forming a toner image on a second side of the media sheet. Examples of the device 10 include Model Nos. C750 and C752, each available from Lexmark International, Inc. of Lexington, Ky., USA.

In some embodiments, as illustrated in FIG. 1, the time necessary to move a media sheet from the input tray 11 to the second transfer area 40 is less than the time to form a toner image on transfer member 53 and move the toner image to the second transfer area 40. This results in the placement of the toner images on the member 53 before the media sheet is picked from tray 11. Further, the small distance from the tray 11 to the second transfer area 40 provides little room to correct problems with the timing of the media sheets. Therefore, the media sheets should be picked from the tray 11 in a timely manner and accurately moved along the media path 15.

Figure 2:
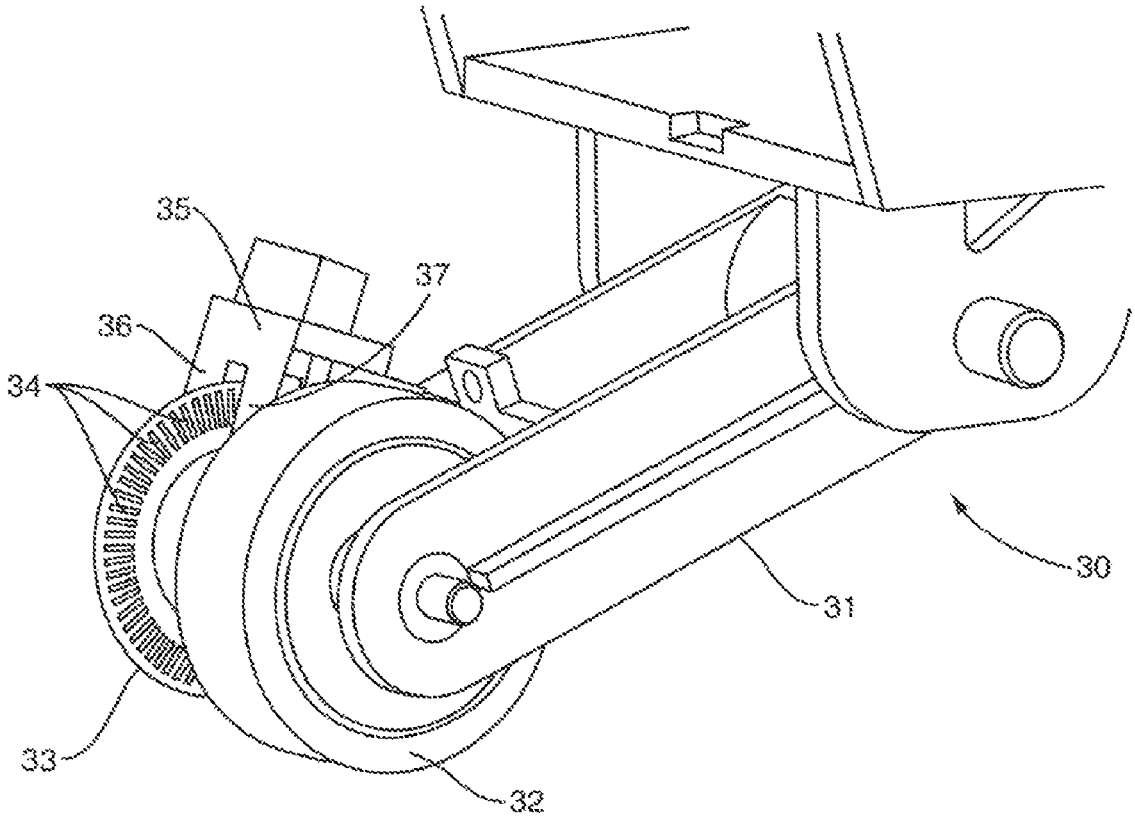
FIG. 2 shows a perspective view of an encoder according to one embodiment.

As illustrated in FIGS. 1 and 2, an encoder 30 is positioned at the input tray 11 to track the position of the media sheet. As best illustrated in FIG. 2, encoder 30 includes an arm 31 that is pivotally attached to a body of the device 10. An encoder roller 32 is positioned towards an end of the arm 31 and remains in contact with a top-most sheet within stack 13. In one embodiment, the encoder roller 32 is a free-rotating roller that rotates responsive to media sheet movement. An encoder wheel 33 is operatively connected to rotate with the roller 32. The encoder wheel 33 includes a plurality of indicators 34, such as apertures or printed lines, spaced along the circumference of the wheel. In one embodiment, each indicator 34 has a substantially rectangular shape and is positioned around a center of the wheel similar to spokes of a wheel. In one embodiment, each indicator 34 is substantially the same size and evenly spaced from the other indicators 34. In another embodiment, indicators 34 have a plurality of different shapes and sizes, and may be located at different positions along wheel 33.

A sensor 35 detects rotational movement of the encoder wheel 33. In one embodiment, sensor 35 includes an emitter 36 and a receiver 37. In one embodiment, emitter 36 emits an optical signal that is detected by the receiver 37. As the wheel 33 rotates, the indicators 34 move past the emitter 36 allowing the signal to pass to the receiver 37. Likewise, the other sections of the wheel 33 move past the emitter 36 and prevent the signal from passing to the receiver 37. A controller 100 (FIG. 3) counts the number of pulses and the frequency of the pulses to determine the speed and location of the media sheet, as discussed further below. In one embodiment, the smart pick encoder 30 includes one sensor that defects the rotational movement of the encoder wheel 33 in one direction. In another embodiment, the encoder 30 may include multiple sensors 35 for detecting the rotational movement of the encoder wheel 33 in multiple directions. For example, the smart pick encoder 30 may include a first sensor 35 for detecting clockwise movement of the encoder wheel 33 and a second sensor 35 for detecting counter-clockwise movement of the encoder wheel 33. By sensing both the clockwise and counter-clockwise movement of the encoder wheel 33, the controller 100 may determine the absolute position of the media sheet, even when the movement of the media sheet causes the encoder wheel 33 to move back and forth.

Emitter 36 may generate any color or intensity of light. The emitter 36 may generate monochromatic and/or coherent light, such as for example, a gas or solid-state laser. Alternatively, emitter 36 may emit non-coherent light of any color or mix of colors, such as any of a wide variety of visible-light, infrared or ultraviolet light emitting diodes (LEDs) or incandescent bulbs. In one embodiment, emitter 36 generates optical energy in the infrared range, and may include an infrared LED. The receiver 37 may comprise any sensor or device operative to detect optical energy emitted by emitter 36. In one specific embodiment, the emitter 36 is an infrared LED optical emitter, and the receiver 37 is a silicon phototransistor optical detector.

Figure 3:
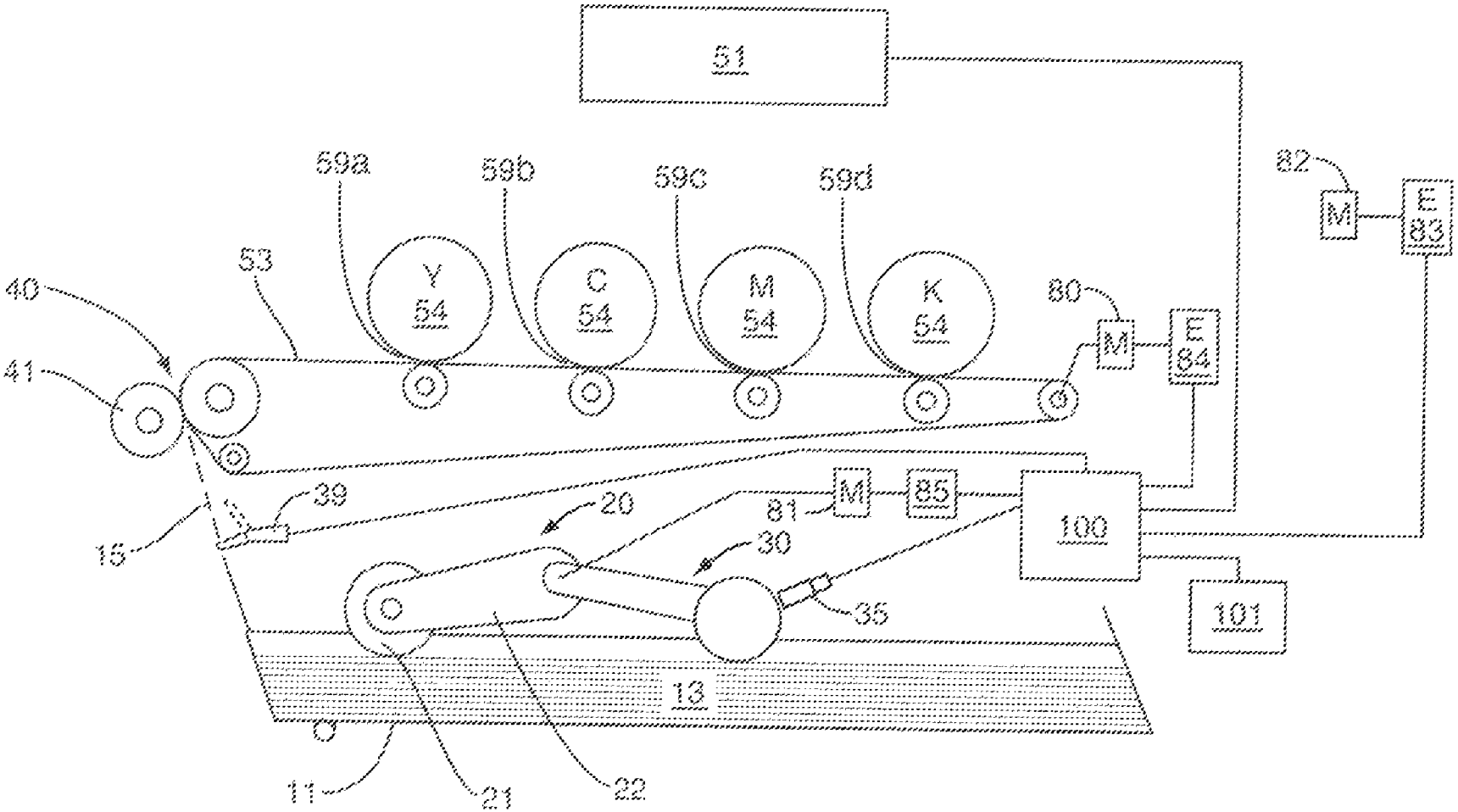
FIG. 3 shows a schematic view of a pick mechanism and an encoder according to one embodiment.

FIG. 3 illustrates one embodiment of the input area and media path 15 leading to the second transfer area 40. The encoder 30 is positioned within the input area to determine the movement of the media sheets from the media stack 13. A second sensor 39 is positioned along the media path 15 between the input tray 11 and the second transfer area 40. In one embodiment, the second sensor 39 is positioned about 30 mm to 40 mm upstream from the second transfer area 40. The second sensor 39 determines the exact position of a leading edge or trailing edge of the media sheet as it moves towards the second transfer area 40. A wide variety of media sensors are known in the art. In general, the sensor 39 may comprise an electro-mechanical contact that is made or broken when a media sheet trips a mechanical lever disposed in the media sheet path; an optical sensor whereby a media sheet blocks, attenuates, or reflects optical energy from an optical source to an optical detector; an opto-mechanical sensor, or other sensor technology, as well known in the art.

Controller 100 oversees the timing of the toner images and the media sheets to ensure the two substantially coincide at the second transfer area 40. Once the media sheet arrives at the second transfer area 40, the controller 100 controls the pick mechanism 20 to move the media sheet at a predetermined process velocity $V_p$. In one embodiment, controller 100 operates such that the toner image and the media sheet coincides at the second transfer area within ±0.5 mm. In one embodiment illustrated in FIG. 3, controller 100 includes a microcontroller with associated memory 101. In one embodiment, controller 100 includes a microprocessor, random access memory, read only memory, and in input/output interface. Controller 100 monitors when the laser printhead 51 begins to place the latent image on the photoconductive members 54, and at what point in time the first line of the toner image is placed onto the transfer member 53. In one embodiment, controller 100 monitors scan data from the laser printhead 51 and the number of revolutions and rotational position of motor 82 that drive the photoconductive members 54. In one embodiment, a single motor 82 drives each of the photoconductive members 54. In one embodiment, two or more motors 82 drive the plurality of photoconductive members 54. In one embodiment, the number of revolutions and rotational position of motor 82 is ascertained by a photoconductor encoder 83.

In one embodiment, as the first writing line of the toner image is transferred onto the member 53, controller 100 begins to track incrementally the position of the image on member 53 by monitoring the number of revolutions and rotational position of a motor 80 that rotates the member 53. In one embodiment, an image transfer encoder 84 ascertains the number of revolutions and rotational position of the motor 80. From the number of rotations and rotational position of the motor 80, the linear movement of member 53 and the image carried thereby may be directly calculated. Since both the location of the toner image on member 53 and the length of the member 53 between the transfer nips 59*a*, 59*b*, 59*c*, 59*d* and second transfer area 40 are known, the distance remaining for the toner images to travel before reaching the second transfer area 40 may also be calculated.

In one embodiment, the position of the image on the member 53 is determined by HSYNCs that occur when the laser printhead 51 makes a complete scan over one of the photoconductive members 54. Controller 100 monitors the number of HSYNCs to calculate the position of the image. In one embodiment, one of the colors, such as black, is used as the HSYNC reference for determining timing aspects of image movement. The HSYNCs occur at a known periodic rate and the intermediate member surface speed is assumed to be constant.

At some designated time, pick mechanism 20 receives a command from the controller 100 to pick a media sheet. At the designated time, controller 100 activates the pick motor 81 that drives pick mechanism 20. Responsive to the motor activation, the pick roller 21 begins to rotate to move the media sheet from the stack 13 in the input tray 11 into the media path 15. As the media sheet moves, the encoder roller 32 and wheel 33 rotate and are detected by the sensor 35. The pick roller 21 continues to rotate to move the media sheet along the media path 15.

The media sheet moves through the beginning of the media path 15 and eventually trips the media sensor 39. At this point, controller 100 ascertains the exact location of the leading edge of the media sheet and may incrementally track the continuing position by monitoring the feedback of an encoder 85 associated with pick motor 81 and/or the smart pick encoder 30. In one embodiment, because of the short length of the media path 15, pick mechanism 20 moves the media sheet from the input tray 11 and into the second transfer area 40. Therefore, the remaining distance from the media sheet to the second transfer area 40 may be calculated from the known distance between the sensor 39 and second transfer area 40 and feedback from the encoder 85 and/or smart pick encoder 30. One embodiment of a feedback system is disclosed in U.S. Pat. No. 6,330,424, assigned to Lexmark International, Inc., and herein incorporated by reference.

The media path 15 may be divided into two separate sections: a first section that extends between the input tray 11 to a point immediately upstream from the sensor 39; and a second section that extends from the sensor 39 to the second transfer area 40. Encoder 30 and/or encoder 85 provide information to the controller 100 when the media sheet is moving through the first section. Information relating to the second section may be obtained from one or more of the sensor 39, encoder 85, and encoder 30.

Controller 100 may use feedback from the encoder 85 and the encoder 30 to correct variations in the media movement through the first section. Controller 100 may be programmed to assume that activation of the motor 81 results in the media sheet being moved a predetermined amount. However, various factors may result in the media sheet advancing through the first section faster or slower than expected. Some variations are corrected during the first section, and other variations are corrected during the second section. In both corrections, pick mechanism 20 is accelerated or decelerated as necessary.

In some embodiments, the media sheet is not moved as fast as expected causing the media sheet to lag behind the expected location. Causes of a lagging media sheet may include the pick roller 21 not engaging with the clutch 29, slippage between the pick roller 21 and the media sheet, and wear of the pick roller 21. In each instance, the media sheet is behind the expected location. The amount of lag may be detected based on feedback from the encoder sensor 35. Sensor 35 detects the amount of movement of the media sheet that is compared by the controller 100 with the expected amount of movement. Discrepancies may then be corrected by accelerating the pick mechanism 20 accordingly.

Some variations from the expected position may be corrected in the second section. Examples of these errors include media stack height uncertainty and poorly loaded media sheets that are pre-fed up the ramp 12. Because these errors are not caused by the pick mechanism 20, the amount of error is unknown until the leading edge is detected at media sensor 39. Once the leading edge is detected, the amount of deviation is determined and the pick mechanism 20 may be accelerated or decelerated as necessary to deliver the media sheet to the second transfer area 40 at the proper time.

Further, feedback from the sensor 39 may be used in combination with the encoder sensor 35 for improving the accuracy associated with moving future media sheets. By way of example, the height of the media stack 13 is unknown when pick roller 21 picks a first sheet. The controller 100 may estimate an expected travel time based on an estimated media stack height and activate the pick mechanism 20 at a corresponding time. Once the leading edge reaches the sensor 39, the feedback from sensor 39 and sensor 35 may be used to determine the distance the sheet traveled from the stack 13 to the sensor 39 to determine the height of the media stack 13. With this information, controller 100 is able to correct the movement of the current media sheet and more accurately predict future pick timings.

Figure 4:
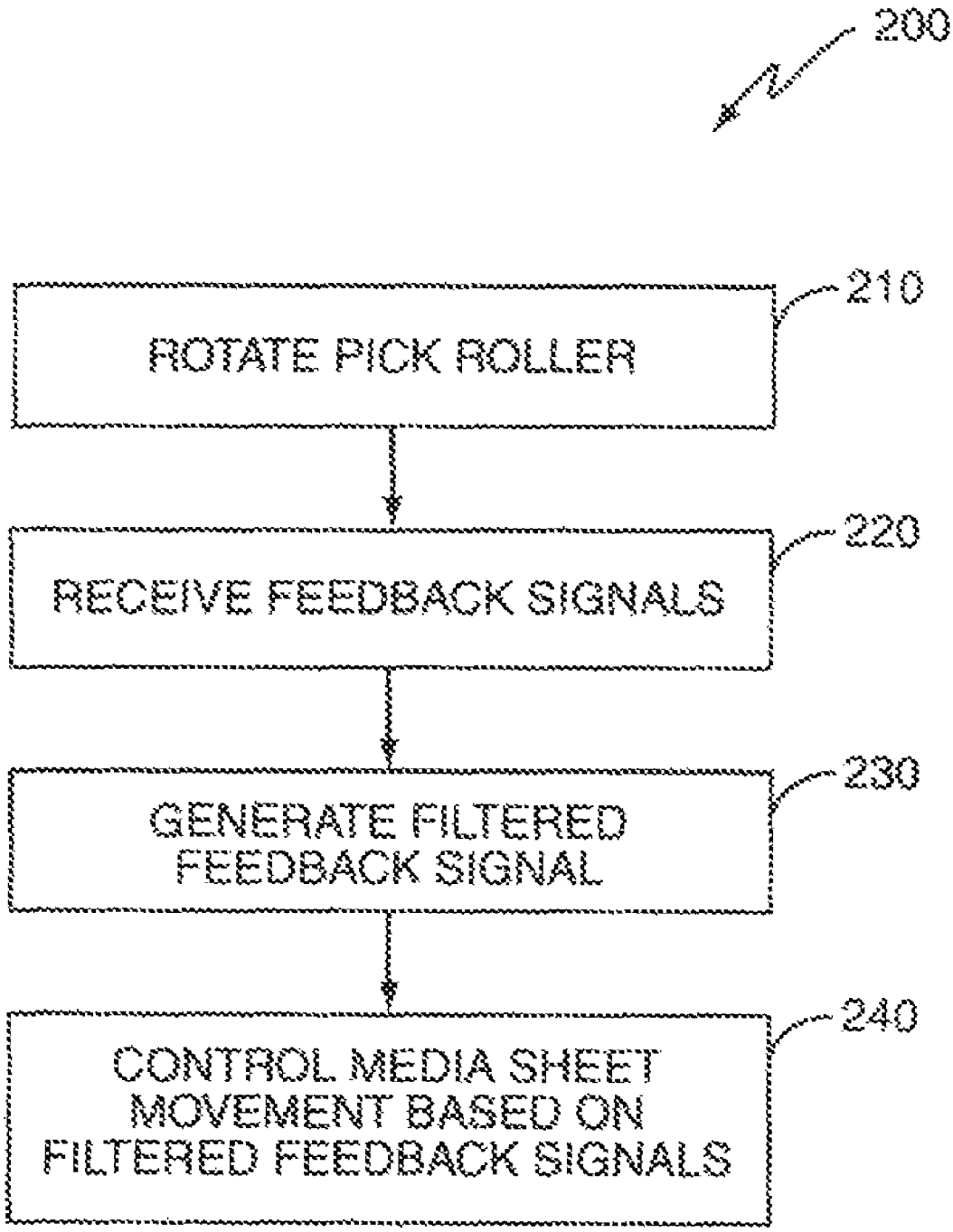
FIG. 4 shows a process diagram for a control process according to one embodiment.

In one embodiment, controller 100 controls the pick mechanism 20 according to the process 200 shown in FIG. 4. The controller 100 drives the pick mechanism 20 to rotate the pick roller 21 and move the top media sheet of the stack 13 (block 210). Subsequently, the pick motor encoder 85 and the smart pick encoder 30 provide feedback signals indicating rotation of the pick roller 21 and movement of the media sheet, respectively (block 220). After filtering a combination of the feedback signals (block 230), the controller 100 controls the movement of the media sheet by driving the pick mechanism 20 based on one or more of the filtered feedback signals (block 240).

Figure 5:
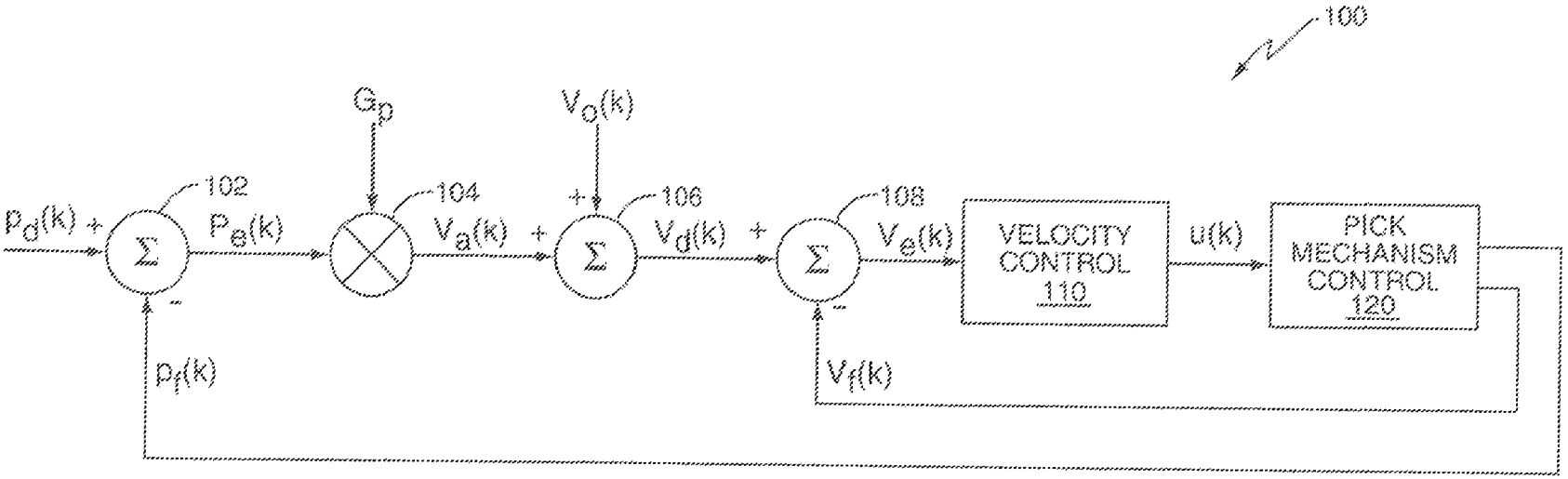
FIG. 5 shows a block diagram of a controller according to one embodiment.

FIG. 5 shows a block diagram for one exemplary controller 100. The following describes the operation of controller 100 in terms of hardware components. However, it will be appreciated that controller 100 may implement the process steps shown in FIG. 4 using hardware components (e.g., combiners, multipliers, sub-controllers, etc.), software, or any combination thereof. In addition, the following defines the control signals involved in the control process relative to a particular sample value, k.

One exemplary controller includes a combiner 102, multiplier 104, combiner 106, combiner 108, velocity controller 110, and pick mechanism controller 120. Combiner 102 combines a desired media position $P_d(k)$ with a feedback media position $P_f(k)$, which represents the current media position, to generate a media position error $P_e(k)$. Multiplier 104 multiplies the media position error $P_e(k)$ by a position control gain $G_p$ to generate a velocity adjustment $V_a(k)$. It will be appreciated that the controller 100 implements a proportion gain controller by multiplying the media position error $P_e(k)$ by the control gain $G_p$.

Subsequently, controller 100 determines a control signal u(k) for the pick motor 81 based on the velocity adjustment value $V_a(k)$. More particularly, a combiner 106 combines the velocity adjustment $V_a(k)$ with a nominal media velocity $V_o(k)$ to determine the desired media velocity $V_d(k)$. Further, a combiner 108 combines the desired media velocity $V_d(k)$ with a feedback media velocity $V_f(k)$, which represents the current media velocity, to determine the media velocity error $V_e(k)$. Based on the media velocity error $V_e(k)$, velocity controller 110 generates the motor control signal u(k). In one embodiment, the control signal u(k) comprises a pulse width modulation (PWM) signal.

Figure 6:
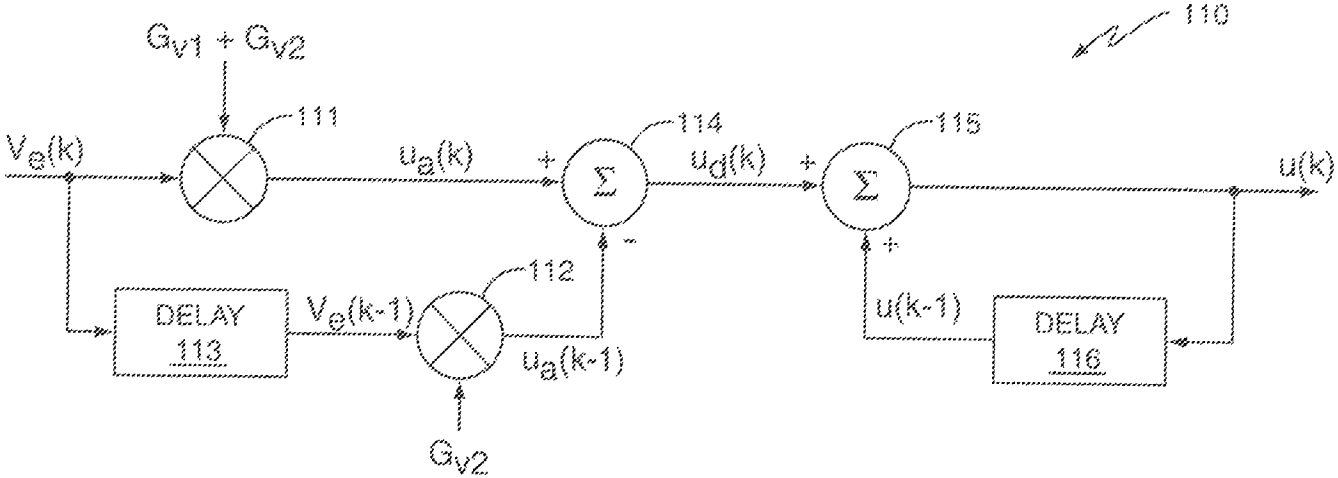
FIG. 6 shows a block diagram of a velocity controller according to one embodiment.

FIG. 6 shows one exemplary block diagram for the velocity controller 110 for deriving u(k) from $V_e(k)$. In one embodiment, velocity controller comprises a multiplier 111, multiplier 112, delay circuit 113, combiner 114, combiner 115, and delay circuit 116. Multiplier 111 multiplies the input media velocity error $V_e(k)$ by the sum of first and second velocity control gains, $G_{v1}$ and $G_{v2}$, to generate a motor adjustment signal $u_a(k)$. Multiplier 112 multiplies a delayed media velocity error $V_e(k-1)$ generated by delay circuit 113 by the second velocity control gain $G_{v2}$ to estimate the motor adjustment signal $u_a(k-1)$ from the previous sample period. Combiner 114 combines the delayed motor adjustment signal $u_d(k-1)$ with the current motor adjustment signal $u_a(k)$ to generate a desired motor adjustment signal $u_d(k)$. To generate the motor control signal u(k), combiner 115 combines the desired motor adjustment signal $u_d(k)$ with a delayed control signal u(k−1) generated by delay circuit 116. Equation (1) mathematically illustrates the operation of the velocity controller 110 of FIG. 6.

$$u(k)=(G_{v1}+G_{v2})V_e(k)-G_{v2}V_e(k-1)+u(k-1) \tag{1}$$

It will be appreciated that the control operation implemented by velocity controller 110 generally corresponds to a proportional-integral (PI) controller.

The pick mechanism controller 120 drives the pick motor 81 responsive to the control signal u(k) to rotate the pick roller 21 and move the media sheet at a desired velocity. As discussed in further detail below, the pick mechanism controller 120 determines the feedback media position $P_f(k)$ and the feedback media velocity $V_f(k)$ based on motor 81 and the resulting movement of the media sheet.

Figure 7:
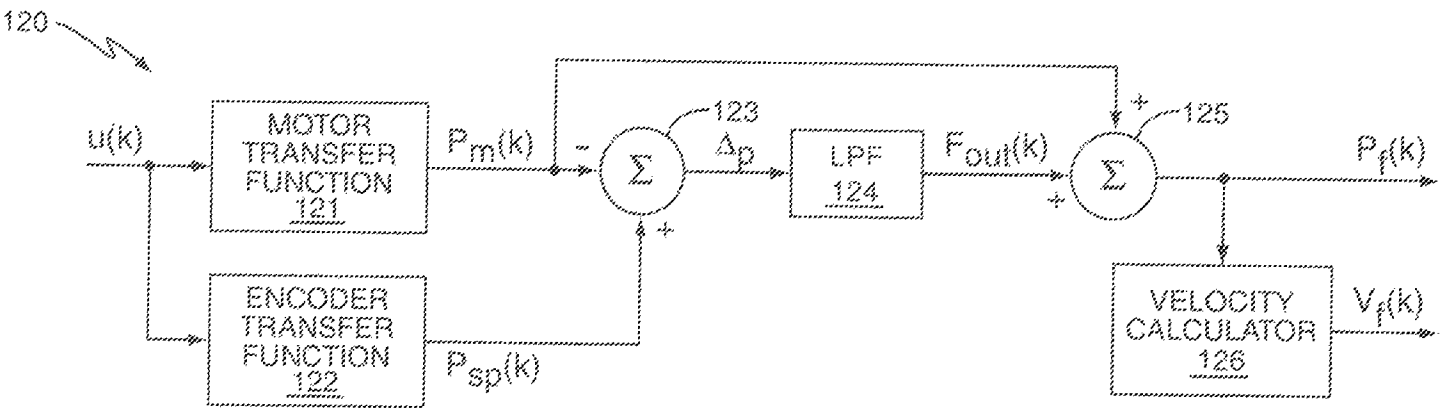
FIG. 7 shows a block diagram of a pick mechanism controller according to one embodiment.

FIG. 7 shows a block diagram for one exemplary pick mechanism controller 120. Responsive to the motor control signal u(k), the pick mechanism controller 120 drives the pick motor 81, which in turn rotates the pick roller 21 and moves a media sheet from the top of stack 13. The movement of the media sheet rotates the encoder roller 32. Based on the movement of the encoder roller 32 and the motor 81, the pick mechanism controller 120 determines a smart pick encoder-based media position $P_{sp}(k)$ and a motor-based media position $P_m(k)$. These operations are represented by the motor transfer function 121 and encoder transfer function 122, respectively, shown in FIG. 7.

Based on the determined $P_m(k)$ and $P_{sp}(k)$ values, the pick mechanism controller 120 determines the feedback media position $P_f(k)$ and the feedback media velocity $V_f(k)$. To this end, one exemplary pick mechanism controller 120 includes a combiner 123, a low pass filter 124, a combiner 125, and a velocity calculator 126. The combiner 123 subtracts $P_m(k)$ from $P_{sp}(k)$ to determine the difference $\Delta_p(k)$ between the media position estimate generated based on the motor encoder 85 and the media position estimate generated based on the smart pick encoder 30 ($\Delta_p(k)=P_{sp}(k)-P_m(k)$). Because the gears driving the pick roller 21 exhibit a transmission error due to gear tooth mesh errors, gear-tooth noise transfers to the media sheet in contact with the encoder roller 32. The gear-tooth noise, which causes a difference in the pick motor speed and the product of the pick roller speed and the gear ratio, causes $P_{sp}(k)$ to include significantly more noise than $P_m(k)$, which is independent of any gear-tooth noise. To reduce the noise, low pass filter 124 filters $\Delta_p(k)$ to generate a filter output $F_{out}(k)$. Combiner 125 combines $F_{out}(k)$ with $P_m(k)$ to determine the feedback media position $P_f(k)$ used by controller 100 as described above. In one embodiment, the low pass filter 124 and combiner 125 generate $P_f(k)$ according to:

$$F_{out}(k)=(f_1+2)g\Delta_p(k-1)+(f_0-1)g\Delta_p(k-2)-f_1gF_{out}(k-1)-f_0gF_{out}(k-2)$$

$$P_{71}(k)=P_m(k)+F_{out}(k). \tag{2}$$

Velocity calculator 126 derives the feedback media velocity $V_f(k)$ from $P_f(k)$ using any known means. In one embodiment, velocity calculator 126 derives $V_f(k)$ according to:

$$V_f(k)=\frac{P_f(k)-P_f(k-1)}{T_s}, \tag{3}$$

where k represents the current sample and $T_s$ represents the control sample time.

As discussed above, controller 100 uses $P_f(k)$ and $V_f(k)$, which are derived from $P_{sp}(k)$ and $P_m(k)$, to control movement of the media sheet through the media path 15. The following mathematically describes how the transfer functions 121, 122 of pick mechanism controller 120 generate $P_{sp}(k)$ and $P_m(k)$ according to one embodiment The motor encoder 85 detects the movement of the pick motor 81 to provide a motor count $C_m(k)$ indicating the number of rotations of the motor 81. In one embodiment, the pick mechanism controller 120 determines the motor-based media position $P_m(k)$ according to:

$$P_m(k)=P_{init}+C_m(k)\Delta_m+P_{off}, \tag{4}$$

where $P_{init}$ represents an initial media position, $\Delta_m$ represents the relationship between the motor count and distance, and $P_{off}$ represents a motor position offset. In one embodiment, the pick mechanism controller 120 may determine the motor-based media position $P_m(k)$ according to:

$$P_m(k)=P_{init}+C'_m\Delta_m+P_{off}, \tag{5}$$

where, $C'_m(k)$ represents an interpolated motor count. In one embodiment, the interpolated motor count $C'_m(k)$ may be calculated according to:

$$C'_m(k) = C_m(k) + \frac{t(k) - t_{m1}}{t_{m1} - t_{m2}}, \quad (6)$$

where t(k) represents the current time stamp, $t_{m1}$ represents time stamp associated with the last detected motor encoder edge, and $t_{m2}$ represents the time stamp associated with the second to last detected motor encoder edge.

Similarly, the encoder sensor 35 monitors the rotational movement of the encoder roller 32 to provide an encoder count $C_{sp}(k)$ used by the pick mechanism controller 120 to determine the position $P_{sp}(k)$ of the media sheet according to the smart pick encoder 30. In one embodiment, the pick mechanism controller 120 determines $P_{sp}(k)$ according to:

$$P_{sp}(k)=P_{init}+C_{sp}(k)\Delta_{sp}, \quad (7)$$

where $\Delta_{sp}$ represents the relationship between the encoder count $C_{sp}(k)$ and distance. In one embodiment, the pick mechanism controller 120 may determine $P_{sp}(k)$ according to:

$$P_{sp}(k)=P_{init}+C'_{sp}\Delta_{sp}, \quad (8)$$

where, $C'_{sp}(k)$ represents an interpolated smart pick encoder count. In one embodiment, the interpolated count $C'_{sp}(k)$ maybe calculated according to:

$$C'_{sp}(k) = C_{sp}(k) + \frac{t(k) - t_{sp1}}{t_{sp1} - t_{sp2}}, \quad (9)$$

where $t_{sp1}$ represents time stamp associated with the last detected smart pick encoder edge, and $t_{sp2}$ represents the time stamp associated with the second to last detected smart pick encoder edge.

Figure 8:
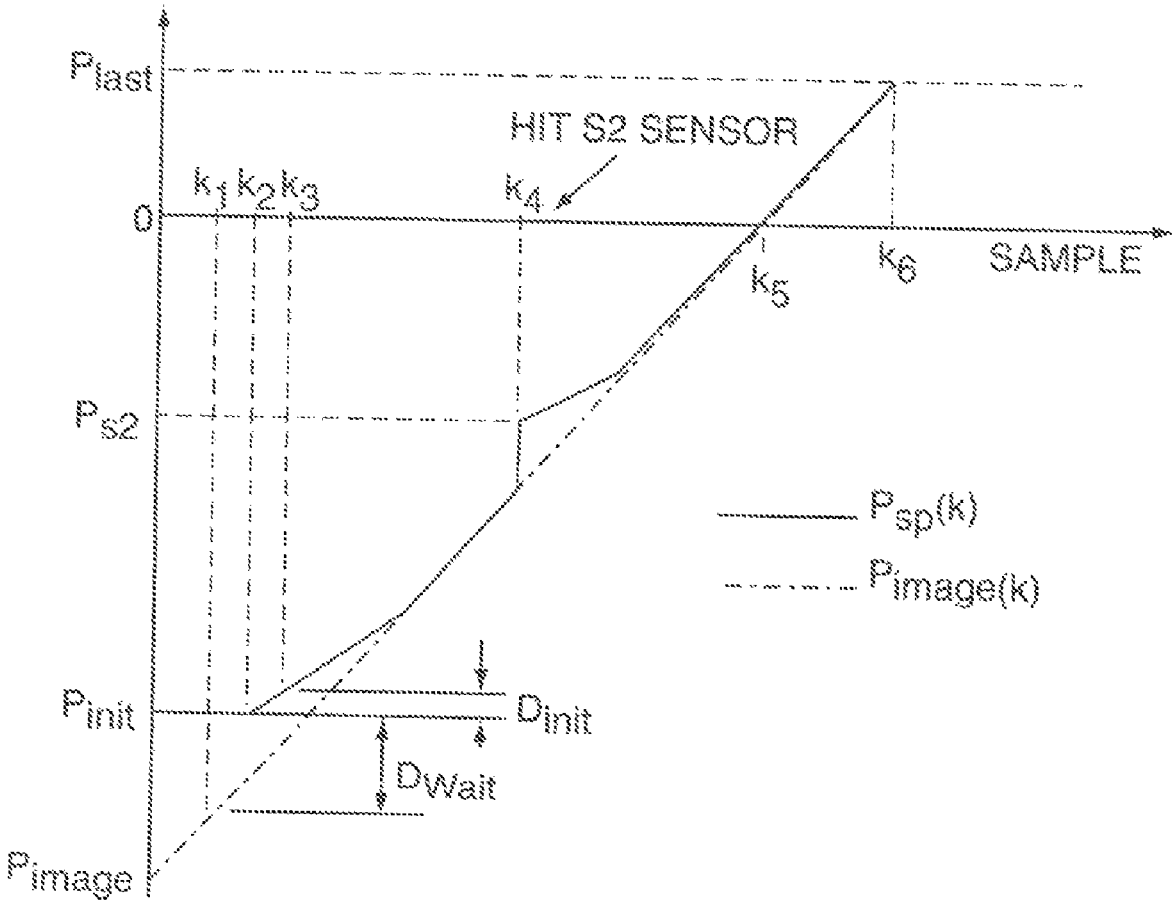
FIG. 8 shows a diagram illustrating movement of the media sheet along the media path versus time.

FIG. 8 shows a graph illustrating the movement of the media sheet through the first and second sections relative to the second transfer area 40. The graph plots position versus samples (k). All samples less than $k_4$ represent the first section (before media sensor 39), while all samples after $k_4$ represent the second section (after media sensor 39). All positions before the second transfer area 40 are illustrated as negative values on the graph, while all positions after the second transfer area 40 are illustrated as positive values.

A predetermined time after some or all of the image is placed on transfer member 53, the controller 100 activates the pick motor 81 and begins tracking an initial wait distance $D_{wait}$ (shown at sample $k_1$). At sample $k_1$, the controller 100 begins gradually increasing the velocity of the pick motor 81 from zero to a pick velocity $V_{pick}(k)$. In one embodiment, controller 100 begins gradually increasing the velocity of the pick motor 81 once the image position $P_{image}(k)$ is greater than $P_{init}-D_{wait}$. The controller 100 may control u(k) to gradually increase the pick motor velocity according to:

$$u(k)=PWM_{initial}+mg(k-k_1)gT_s, \quad (10)$$

where $PWM_{initial}$ represents an initial pulse width modulation (PWM) signal, m represents a slope factor, k represents the current sample, and $T_s$ represents the control sample time.

Once the pick motor 81 reaches the pick velocity $V_{pick}(k)$ (shown at sample $k_2$), pick roller 21 begins rotating to move the top media sheet from the stack 13. During this time, controller 100 sets controls the velocity of the pick motor 81 assuming that $G_p=0$, $V_o(k)=V_{pick}(k)$, and $V_f(k)=V_m(k)$. Movement of the media sheet causes the encoder roller 32 to rotate. Once the encoder roller 32 indicates to the controller 100 that the media sheet has moved an initial distance $D_{init}$ (shown at sample $k_3$), the controller 100 resets $G_p$ and $V_e(k)$ to predetermined values and controls the pick motor velocity to achieve a desired velocity $V_d(k)$ based on $P_f(k)$ and $V_f(k)$ as discussed above. In one embodiment, the controller 100 determines that the media sheet has moved the initial distance $D_{init}$ once the position of the media sheet as determined by the smart pick encoder 30 ($P_{sp}(k)$), is greater than $P_{init}+D_{init}$. In one embodiment, $D_{init}$ ranges between 0.5 mm and 2 mm, and generally equals 1 mm. Between samples $k_3$ and $k_4$, controller 100 controls the movement of the media sheet through the first section based on the estimated initial media position $P_{init}$, the image position $P_{image}(k)$, and the calculated media positions $P_{sp}(k)$ and $P_m(k)$ determined based on signals provided by the smart pick encoder 30 and the motor encoder 85, respectively.

At sample $k_4$ shown in FIG. 8, the media sheet triggers the media sensor 39 located at the predetermined sensor position $P_{S2}$. In one embodiment, $P_{S2}$ is around 40 mm from input tray 11. Based on the output from sensor 39, controller 100 updates the initial media position $P_{init}$ to improve the accuracy of the $P_{init}$ used to control the movement of the media sheet. After the media sheet passes the sensor 39, controller 100 controls the velocity of the motor 81 based on the revised $P_{init}$ using Equations (3)-(9) above to control the movement of the media sheet through the second section until the media reaches the second transfer area 40 (shown at sample $k_5$). Once the media sheet reaches a final location ($P_{last}(k)$) beyond the second transfer area 40, shown at sample $k_6$, controller 100 stops controlling the movement of the media sheet.

The above describes one exemplary control method and device for moving a media sheet through the first and second sections of a media path 15 to ensure that the media sheet and the image substantially coincide at the second imaging area 40. Moving the media sheet through the first section as described above corrects leading edge errors caused by pick roller slippage, wear of the pick roller 21, clutch errors, gear backlash, and/or variations in the pick mechanism 30. For example, one exemplary clutch may have a clutch error ranging between 0 mm and 6.6 mm. In another example, the lost motion due to gear backlash may be as large as 15 mm.

Moving the media sheet through the second section as described above corrects errors caused by leading edge uncertainty and/or media stack height uncertainty. Leading edge uncertainty is caused by media sheet tolerances, input tray tolerances, and/or nominal clearance tolerances in the input area design. One or more of these tolerance values causes an uncertainty in the location of the leading edge of the media sheet in the input tray 11 relative to the second transfer area 40. In one embodiment, the uncertainty may range between 0 mm and 4 mm. Media stack height uncertainty is caused by the uncertainty associated with the current height of the stack 13. The height of the stack 13 has an uncertainty of ±0.5 H in the location of the top media sheet's leading edge, where H represents the height of a full stack 13 in the input tray 11. It will be appreciated that sensor 39 provides feedback that may be used to update $P_{init}$ to remove some, if not all, of the leading edge and/or stack height uncertainties.

The following provides experimental results generated based on the above-described control method and device. These results assess two kinds of error: control error and total error. The control error consists of errors that the smart pick encoder 30 can defect, e.g., clutch errors, gear backlash, etc.

In one embodiment, the control error is defined as the difference between the image position $P_i(k)$ and the media position $P_{sp}(k)$ derived from the smart pick encoder 30 when the image position is at the second transfer area 40. The above-described control method and device minimizes the control error.

The total error represents the difference between the image position and the leading edge of the media sheet when the image position is at the second transfer area 40. Because the second transfer area 40 does not have room for a sensor to detect the leading edge of the media sheet, a flag sensor is disposed a distance x downstream from the second transfer area 40. In one embodiment the distance x is between 5 mm and 20 mm from the second transfer area 40. In one embodiment, the distance x is 14.6 mm from the second transfer area. Based on $T_f$, which represents the time the leading edge of the media hits the flag sensor if there is no leading edge error, the current time stamp $T_s$, which represents the timestamp of the flag sensor when the media goes through the flag sensor, and the process speed $V_p$, the total edge error may be estimated by:

$$T_f = \frac{x + P_{init}}{V_p} \tag{11}$$

$$\text{Error} = (T_s - T_f)gV_p,$$

The total error consists of errors that the pick mechanism 30 can and cannot detect. The above-described control method and device reduces the total error.

Figure 9:
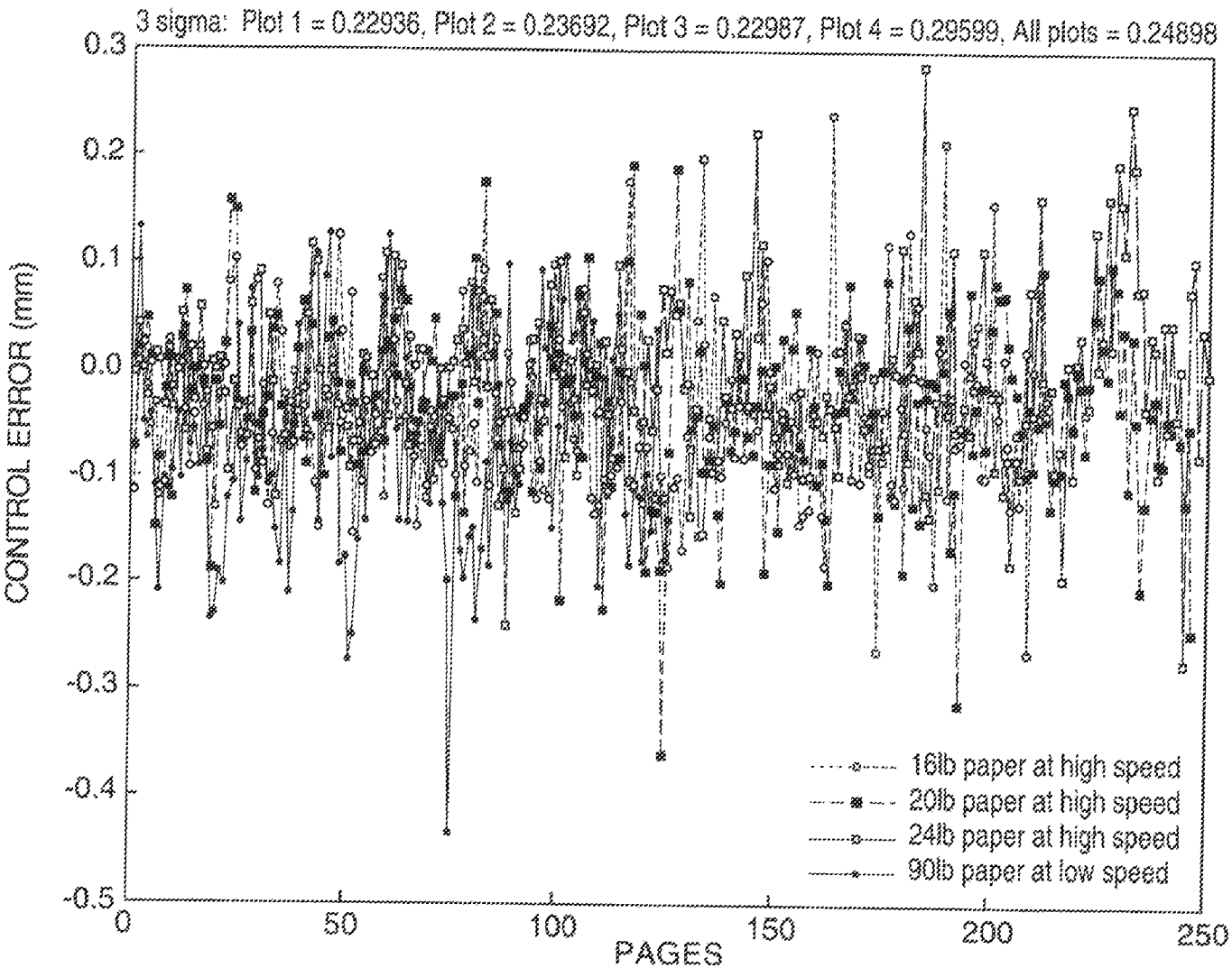
FIG. 9 shows a diagram of control error experimental results.
Figure 10:
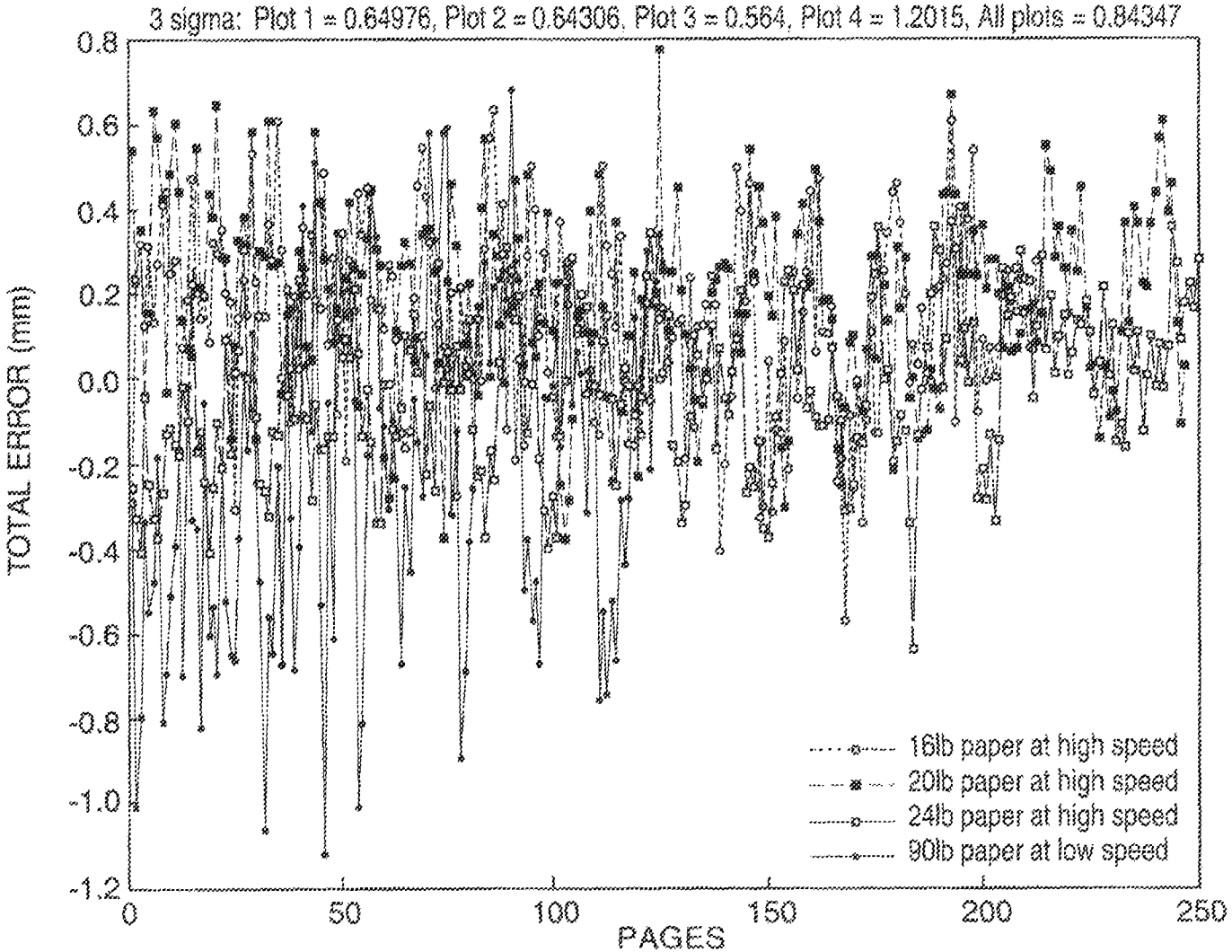
FIG. 10 shows a diagram of total error experimental results.

FIGS. 9 and 10 illustrate the experimental control error and total error results, respectively, for different types of media sheets along with the 3σ standard deviations for each. The experimental tests were performed on stacks of 16, 20, 24, and 90 pound media sheets, and are based on the following assumptions:

| Parameter | Value |
|---|---|
| $f_0$ | 0.9608 |
| $f_1$ | −1.9603 |
| $P_{image}$ (k = 0) | −130 mm |
| $P_{init}$ | −95 mm |
| $D_{init}$ | −40 mm |
| $G_{v1}$ | 0.00039787 |
| $G_{v2}$ | 0.00036433 |
| $P_{last}$ (k) | 40 mm |
| $G_p$ | 35 |
| $PWM_{initial}$ | 0.1 |
| m | 1.5 |
| $P_{S2}$ | 38 mm |
| $V_{pick}$ | 0.5 $V_p$ |
| $\Delta_{sp}$ | 0.2822 mm/count |
| $V_p$ | 5.5033 mm/sec |

As shown in FIG. 9, the control error mostly stays within ±0.2 mm. As shown in FIG. 10, the total error for the 16, 20, and 24 pound media sheets mostly stays within ±0.5 mm. It will be appreciated that the large variation in the total error for the 90 pound media sheets is generally attributed to vertical pick tire motion caused by the stiff nature of the 90 pound media. While the above-described control method and device generally does not address this error source, a hardware design modification may be used to reduce this type of error.

Figure 11:
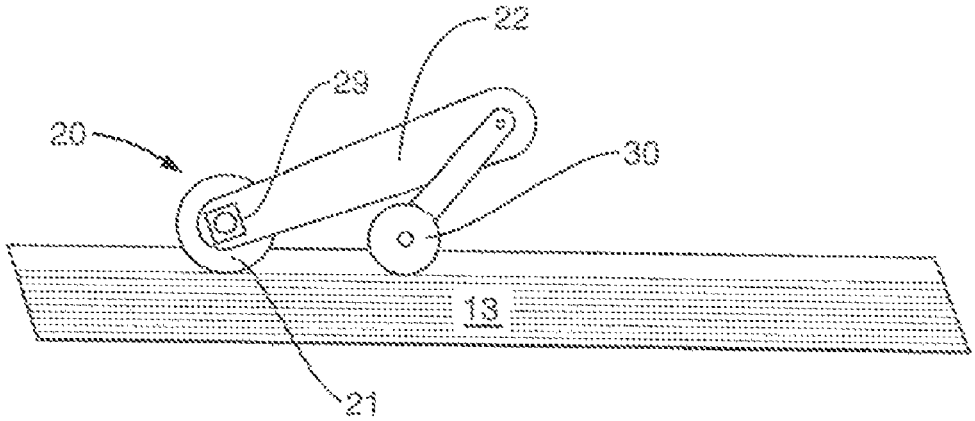
FIG. 11 shows a schematic view of a pick mechanism and an encoder according to one embodiment.

The above describes a control method and device that relies on a smart pick encoder 30 positioned relative to the pick mechanism 20 on an opposite side of the pick mechanism pivot, as shown in FIG. 1. In other embodiments, however, the smart pick encoder 30 may have a different orientation relative to the pick mechanism pivot. In one embodiment, the smart pick encoder 30 may be positioned on the same side of the pick mechanism pivot, as shown in FIG. 11.

Figure 12:
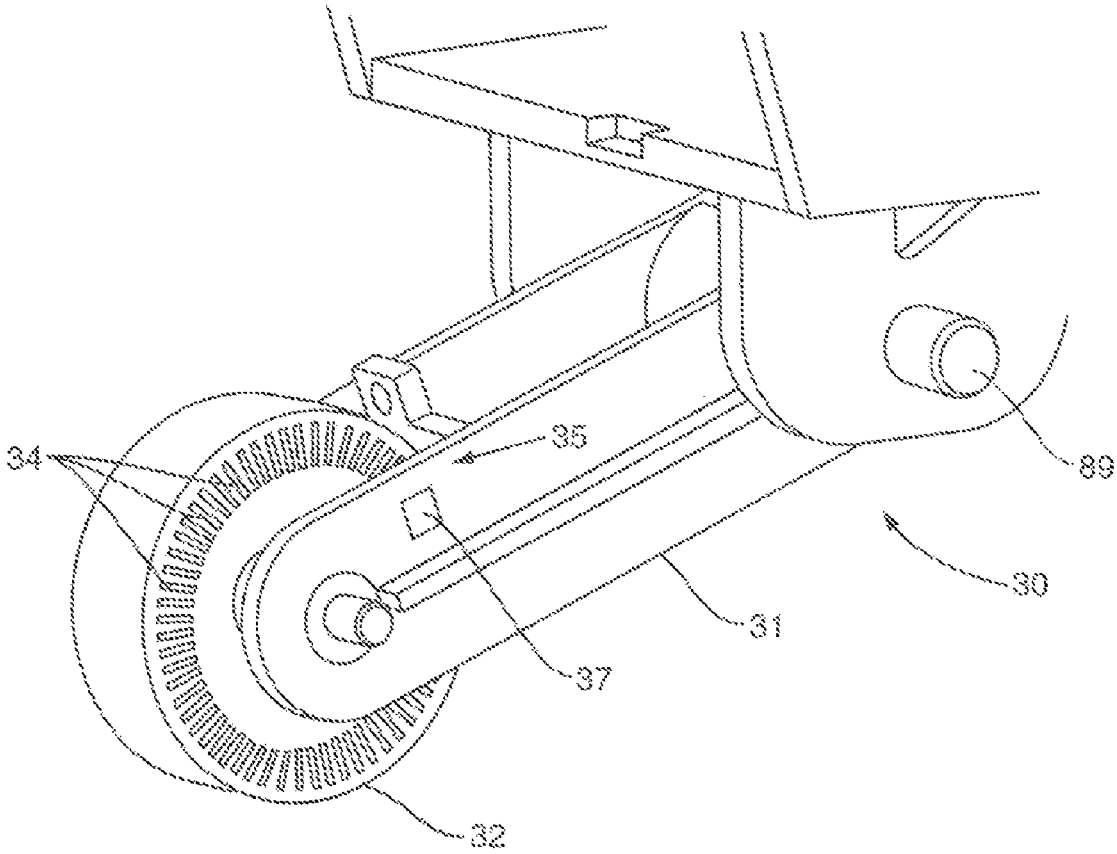
FIG. 12 shows a perspective view of an encoder according to one embodiment.

The above also describes a control method and device that relies on the encoder 30 of FIG. 2. However, the above-described control method and device is not so limited. FIG. 12 illustrates another applicable embodiment of the encoder 30. Roller 32 is rotatably mounted on an arm 31. The roller 32 includes a plurality of indicators 34 that move past a sensor 35. The sensor 35 includes an emitter (not illustrated) and a receiver 37. The roller 32 is maintained in contact with the top-most sheet of the media stack 13 as the arm 31 pivots about a point 89. Movement of the top-most media sheet causes the roller 32 to rotate which is detected by the sensor 35.

Figure 13:
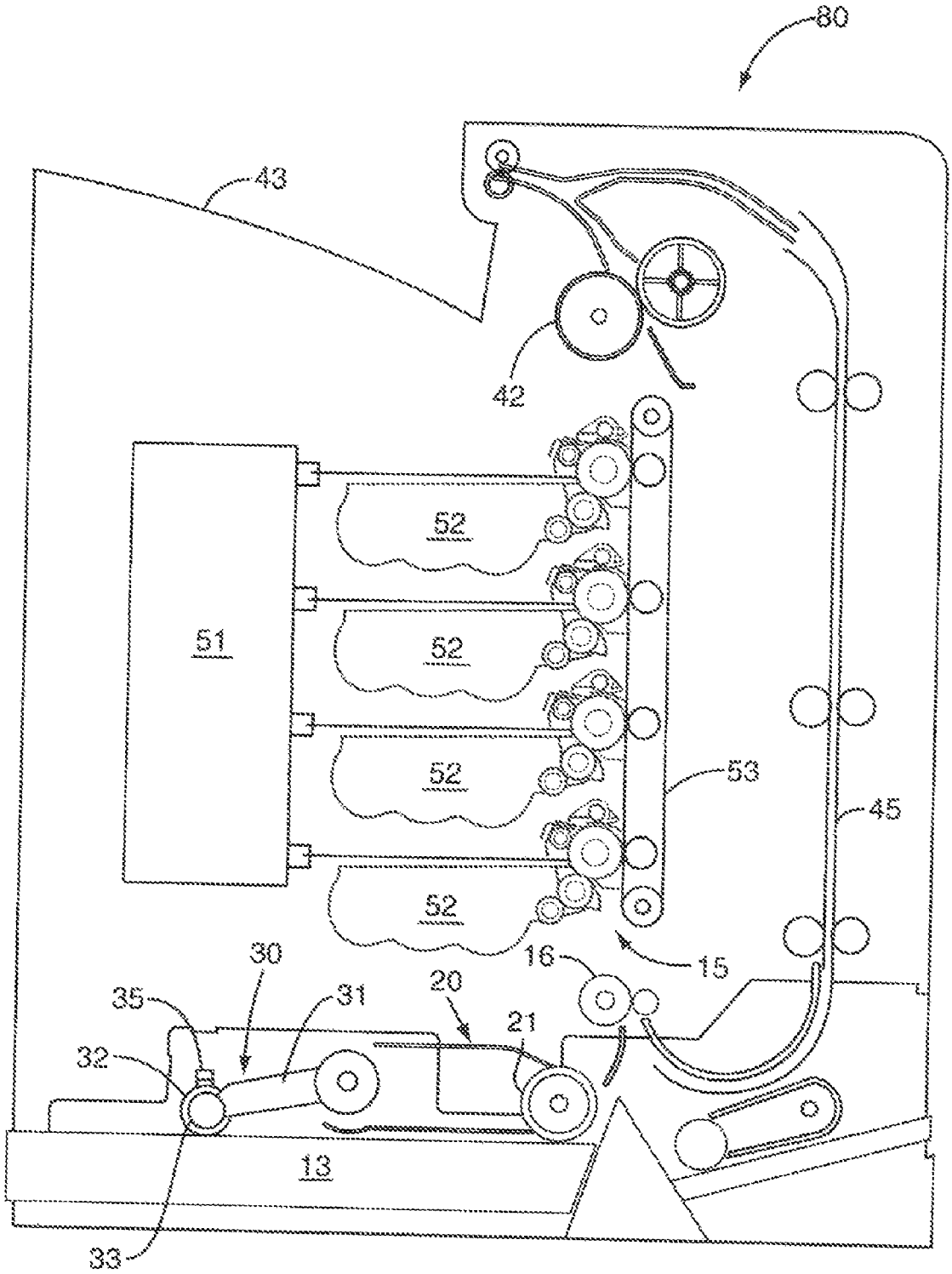
FIG. 13 shows a schematic view of an image forming device according to one embodiment.

It should be noted that the image-forming device 10 illustrated in the previous embodiments is a two-stage image-forming device. In two-stage transfer device, the toner image is first transferred to a moving transport member 53, such as an endless belt, and then to a print media at the second transfer area 40. However, the present embodiments are not so limited, and may be employed in single-stage or direct transfer image-forming devices 80, such as the image-forming device shown in FIG. 13.

In such a device 80, the pick mechanism 20 picks an upper most print media from the media stack 13, and feeds it into the primary media path 15. Encoder 30 is positioned at the input area and includes an arm 31 including a roller 32 and encoder wheel 33. The roller 32 is positioned on the top-most sheet and movement of the sheet causes the encoder roller 32 and encoder wheel 33 to rotate, which is then detected by sensor 35. In one embodiment, media rollers 16 are positioned between the pick mechanism 20 and the first image forming station 52. The media rollers 16 move the media sheet further along the media path 15 towards the image forming stations 52, and may further align the sheet and more accurately control the movement. In one embodiment, the rollers 16 are positioned in proximity to the input area such that the media sheet remains in contact with the encoder 30 as the leading edge moves through the rollers 16. In this embodiment, encoder 30 may monitor the location and movement of the media sheet which may then be used by the controller 100. In another embodiment, the media sheet has moved beyond the encoder 30 prior to the leading edge reaching the rollers 16.

The transport member 53 conveys the media sheet past each image-forming station 52. Toner images from the image forming stations 20 are directly transferred to the media sheet. The transport member 53 continues to convey the print media with toner images thereon to the fuser 42. The media sheet is then either discharged into the output tray 43, or moved into the duplex path 45 for forming a toner image on a second side of the print media.

In one embodiment, the pick roller 21 is mounted on a first arm 22, and the encoder roller 32 is mounted on a second arm 31. In one embodiment, the pick roller 21 is positioned downstream of the encoder roller 32.

The encoder 30 may further be able to detect the trailing edge of the media sheet as it leaves the media stack 13. As the media sheet moves along the media path, the encoder 30 senses the sheet until the trailing edge moves beyond the encoder roller 32. At this point, the roller 32 stops rotating and a signal may be sent to the controller 100 indicating the timing and location of the trailing edge. The controller 100 may then begin picking the next media sheet based on the known location of the trailing edge. By knowing this location, the controller 100 does not need to wait for a minimum gap to be formed between the trailing edge and the next sheet. The next sheet may then be picked once the trailing edge is clear and the pick mechanism 20 is ready to pick the next media sheet from the stack 13.

Such early picking of a media sheet may have several advantages. First, picking the next media sheet early allows the pick mechanism 20 to tolerate slippage between the pick roller 21 and media sheet, and clutch errors. Second, the staging system may foe able to tolerate more error when the media sheet is early because it can eliminate more error by decelerating than by accelerating. Third, if no media sheet, movement is detected by the sensor 35, the controller 100 may stop the pick mechanism 28 and reinitiate the pick. Reinitiating may occur prior to the error becoming so large that the staging zones can not remove the error.

The above-described method and devices may use a different motor velocity to pick the top media sheet from the stack 13 ($V_{pick}(k)$) than the process speed $V_p$ used to control movement of the media sheet through the first and second sections of the media path 15. The slower pick velocity $V_{pick}(k)$ helps to pick a single media sheet from the stack 13, and therefore reduces the likelihood of picking multiple media sheets at a time.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present embodiments may be carried out in other specific ways than those herein set forth without departing from the scope and essential characteristics of the embodiments. These embodiments are, therefore, to be considered in all respects as illustrative and not restrictive, and all changes coming within the meaning and equivalency range of the appended claims are intended to be embraced therein.

What is claimed is:

1. A method of controlling movement of a media sheet within an image forming device comprising:

driving a pick mechanism to rotate a pick member in contact with the media sheet to move the media sheet from an input area;

receiving a first signal indicating rotation of the pick member;

receiving a second signal from an encoder in contact with the media sheet and indicating movement of the media sheet in a first direction and in a second direction;

filtering a combination of the first and second signals to generate one or more filtered feedback signals; and controlling the movement of the media sheet by driving the pick mechanism based on the one or more filtered feedback signals and a position of a toner image on a transport belt to move the media sheet with the pick mechanism to a transfer area where the toner image is placed on the media sheet, wherein the one or more filtered feedback signals comprises a velocity feedback signals, and wherein controlling the movement of the media sheet comprises driving the pick mechanism based on the velocity feedback signal to control a rotational velocity of the pick member, and wherein the one or more filtered feedback signals comprises a position feedback signal, and wherein controlling the movement of the media sheet comprises driving the pick mechanism based on the position feedback signal and the velocity feedback signal to control a rotational velocity of the pick member.

2. The method of claim 1 wherein the encoder comprises a free-rotating member that rotates responsive to media sheet movement.

3. The method of claim 1 wherein controlling the movement of the media sheet comprises driving the pick mechanism to adjust a rotational speed of the pick member based on the one or more filtered feedback signals.

4. The method of claim 1 wherein controlling the movement of the media sheet comprises driving the pick mechanism to rotate the pick member at a first speed based on the one or more filtered feedback signals during movement of the media sheet a first distance, and driving the pick mechanism to rotate the pick member at a second speed based on the one or more filtered feedback signals during movement of the media sheet after the first distance.

5. The method of claim 1 further comprising receiving a third signal from a sensor disposed downstream from the input area responsive to detecting the media sheet at the sensor.

6. The method of claim 5 wherein controlling the movement of the media sheet comprises driving the pick mechanism based on the one or more filtered feedback signals and the third signal.

7. The method of claim 1, wherein the controlling comprises determining speed and location of the media sheet based upon the received second signal.

8. A method of controlling movement of a media sheet within an image forming device comprising:

driving a pick mechanism to rotate a pick member in contact with the media sheet to move the media sheet from an input area;

receiving a first signal indicating rotation of the pick member;

receiving a second signal from an encoder in contact with the media sheet and indicating movement of the media sheet in a first direction and in a second direction;

determining a current position and a current velocity of the media sheet based upon the received first and second signals, comprising filtering a combination of the first and second signals, wherein the current position and the current velocity of the media sheet are based upon the filtered combination of the first and second signals; and controlling the movement of the media sheet by driving the pick mechanism based on the current position and the current velocity of the media sheet, and based on a position of a toner image on a transport belt to move the media sheet with the pick mechanism to transfer area where the toner image is placed on the media sheet, wherein the current position and current velocity of the media sheet comprise a position feedback signal and a velocity feedback signal, respectively, and wherein controlling the movement of the media sheet comprises driving the pick mechanism based on the position feedback signal and the velocity feedback signal to control a rotational velocity of the pick member.

* * * * *